US006349518B1

(12) United States Patent
Chacko

(10) Patent No.: US 6,349,518 B1
(45) Date of Patent: Feb. 26, 2002

(54) METHOD OF INSULATING AN ATTIC CAVITY AND INSULATED ATTIC CAVITY

(75) Inventor: Jacob T. Chacko, Pickerington, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/450,944

(22) Filed: Nov. 29, 1999

(51) Int. Cl.[7] ..... E04B 1/74
(52) U.S. Cl. ..... 52/404.1; 52/404.3; 52/407.1
(58) Field of Search ..... 52/639, 407.3, 52/404.3, 742.13, 404.1, 408

(56) References Cited

U.S. PATENT DOCUMENTS 3,683,786 A * 8/1972 Grange ..... 98/32
4,134,242 A 1/1979 Musz et al.
4,565,037 A * 1/1986 DeSchane ..... 52/95
4,696,138 A 9/1987 Bullock
4,707,960 A * 11/1987 Bullock ..... 52/404
4,829,738 A 5/1989 Moss
5,267,422 A 12/1993 Crall, Jr.
5,287,674 A 2/1994 Sperber
5,365,716 A 11/1994 Munson
5,367,849 A 11/1994 Bullock
5,724,780 A 3/1998 Bolich
5,819,496 A * 10/1998 Sperber ..... 52/742.13

* cited by examiner

*Primary Examiner*—Beth A. Stephan
(74) *Attorney, Agent, or Firm*—Inger H. Eckert; Stephen W. Barns

(57) ABSTRACT

A method of insulating an attic cavity includes assembling a plurality of trusses to define an attic cavity, the trusses having sloped top beams so that the attic cavity has a reduced height end portion at least one end of the trusses. A screen material is applied to the attic cavity at the reduced height end portion of the attic cavity. Loosefil insulation material is blown into the end portion of the attic cavity to insulate the end portion of the attic cavity. The remaining portion of the attic cavity is insulated.

21 Claims, 2 Drawing Sheets

METHOD OF INSULATING AN ATTIC CAVITY AND INSULATED ATTIC CAVITY

TECHNICAL FIELD AND INDUSTRIAL APPLICABILITY OF THE INVENTION

This invention relates to insulating attic cavities, and more particularly to applying loosefil insulation material into attic cavities by blowing the insulation material into the attic cavities.

BACKGROUND OF THE INVENTION

Residential, commercial and industrial buildings are commonly insulated with an insulation material to reduce the flow of heat out of the building in the winter and to reduce the flow of heat into the building in the summer. Various structural components of the building define insulation cavities in which the insulation material is placed. Such insulation cavities include attic cavities, wall cavities and underfloor cavities.

Typical insulation materials used in the insulation cavities of buildings include fibrous polymer insulation, fibrous mineral insulation, and cellulose insulation. Mineral fiber insulation materials are usually either made of glass fibers or other mineral fibers such as rock wool.

A significant portion of the insulation placed in the insulation cavities of buildings is in the form of insulation fibers that are bonded together with a binder material into a monolithic structure in the form of a batt or blanket, or in the form of an encapsulated collection of fibers. By way of contrast, in many insulation applications the fibers are collected together in the form of smaller insulation units, such as tufts, nodules, cubes or flakes, that are installed into wall or attic insulation cavities by pneumatically blowing the insulation into wall cavities or attic cavities. The blowing is accomplished using a hose and a forced air blower, and the blown insulation material is known as loosefil insulation. Optionally, the loosefil insulation material is either bindered or binderless. The insulation value of the loosefil insulation material is generally dependent on the thickness of the accumulated blown insulation material within the attic cavity or wall cavity. The insulation value is also dependent on the density of the loosefil insulation material.

A problem with existing loosefil installation methods is that where the building roof is sloped, the attic insulation cavity typically has a reduced height at the edges of the attic cavity. This results in a situation in which the thickness of the loosefil insulation material at the edges of the attic cavity is not as great as in the remaining portion of the attic cavity. The consequence is the undesirable situation in which the attic cavity has an insulation value (R-value) greater in the middle portion of the attic cavity than at the edge portions, thereby allowing excessive heat transfer to or from the building at the edges of the building. This excessive heat transfer requires higher heating and cooling costs for the building.

It would be advantageous if there could be developed a method for installing loosefil insulation into attic cavities that could overcome the propensity of attic cavities to have lower insulation values or R-values at the eaves or edges of the attic space.

SUMMARY OF THE INVENTION

The above objects as well as other objects not specifically enumerated are achieved by a method of insulating an attic cavity comprising assembling a plurality of trusses to define an attic cavity, the trusses having sloped top beams so that the attic cavity has a reduced height end portion at least one end of the trusses. A screen material is applied to the attic cavity at the reduced height end portion of the attic cavity. Loosefil insulation material is blown into the end portion of the attic cavity to insulate the end portion of the attic cavity. The remaining portion of the attic cavity is insulated.

According to this invention, there is also provided a method of insulating an attic cavity including assembling a plurality of trusses to define an attic cavity, the trusses having sloped top beams so that the attic cavity has a reduced height end portion at each end of the trusses. A flexible, porous screen material is applied to the attic cavity at the reduced height end portions of the attic cavity. Loosefil insulation material is blown into the end portions of the attic cavity to insulate the end portions of the attic cavity. The remaining portion of the attic cavity is insulated.

According to this invention there is also provided an attic cavity of a building insulated by assembling a plurality of trusses to define the attic cavity, the trusses having sloped top beams so that the attic cavity has a reduced height end portion at least one end of the trusses. A screen material is applied to the attic cavity at the reduced height end portion of the attic cavity, and loosefil insulation material is blown into the end portion of the attic cavity to insulate the end portion of the attic cavity. The remaining portion of the attic cavity is insulated.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

While the description and drawings disclose insulation products of fiberglass insulation, it is to be understood that the insulation material can be any compressible fibrous insulation material, such as rock wool or other mineral fibers, or such as insulation material comprised of polyethylene, cellulose or other organic fibers.

Figure 1:
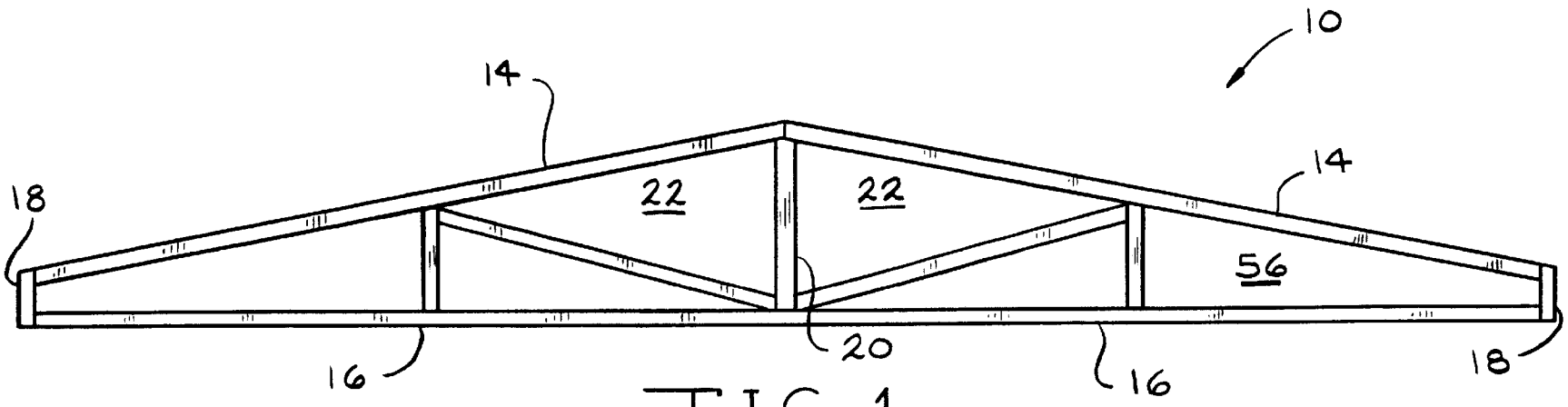
FIG. 1 is a schematic view in elevation of a truss used to frame the attic of a building.

As shown in FIG. 1, the truss 10 consists of two sloped chords or top beams 14, a lower chord or beam 16, outside vertical beams 18 and an inside vertical beam 20. A plurality of trusses similar to truss 10 define an attic cavity, indicated at 22. The attic cavity 22 has a reduced height at each end of the truss 10.

Figure 2:
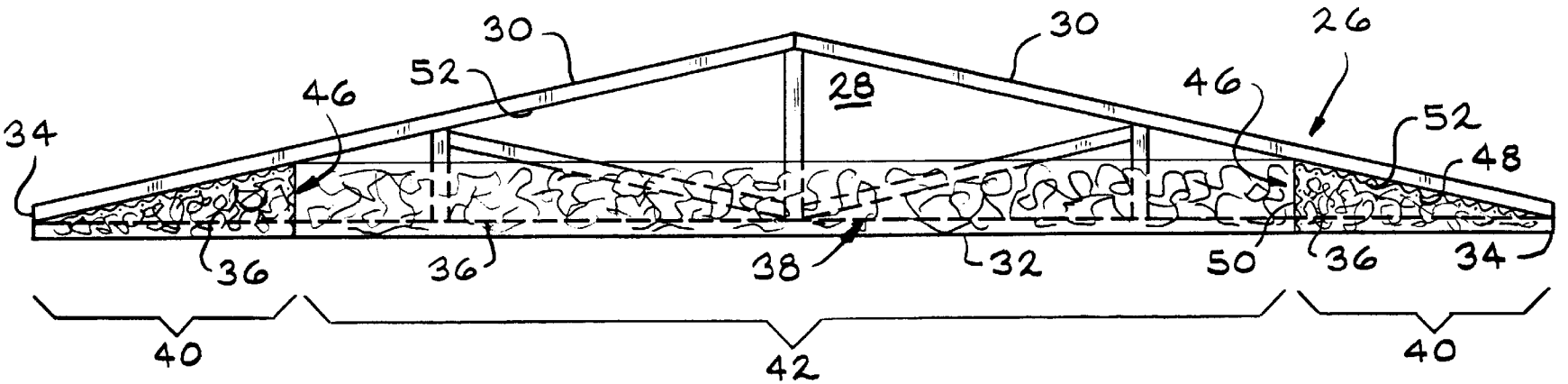
FIG. 2 is a schematic view in elevation of a truss similar to that shown in FIG. 1, with loosefil insulation having been installed in the attic cavity defined by the truss, according to the method of the invention.

As shown in FIG. 2, a different truss 26 is formed without any outside vertical beams (like the beams 18 in FIG. 1). The truss 26 defines an attic cavity 28, and includes sloped top beams 30, and a joist or lower beam 32. In the embodiment of FIG. 2, the top beams 30 and lower beam 32 converge at the edges 34 of the building, and there is no outside vertical beam. It can be seen that the attic cavity 28 has a reduced height each end of the truss 26. In addition to the truss designs shown in FIGS. 1 and 2, it is to be understood that the truss can include a sloped, rather than completely horizontal, lower chord or beam, not shown, that slopes downward from the center of the building to the edges of the building, but at a lesser slope than that of the top beams 14 or 30. Such a design would allow the interior of the building to have a peaked or cathedral ceiling.

In FIG. 2 fiberglass loosefil insulation material 36 is shown as having been installed in the attic cavity 28. The insulation material 36 can be any insulation material, either bonded or unbonded, suitable for insulating the attic, including such fibrous insulation material as polymer insulation, mineral insulation (including fiber glass), and cellulose insulation. The insulation material 36 has been blown into the attic cavity 28, and has a blown-in height indicated at 38 throughout most of the width of the truss 26, but has a lower or reduced height in the reduced height end portions 40 of the attic cavity 28. It can be seen that the remainder portion 42 of the attic cavity is where the height 38 is generally constant. The height 38 of the insulation material 36 can be any level suitable for insulating the building. Where the building is a manufactured home, the height 38 of the insulation in the remainder portion 42 is typically about 9 or about 12 inches.

A screen material 46 is applied to each reduced height end portion 40 of the truss. The screen material can be a fabric or mat material, either woven or nonwoven, such as for example a screening material, a wet process glass fiber mat, a scrim material, perforated film, or other generally porous materials. The screen material 46 can be generally rigid, but is preferably flexible. The screen material 46 preferably includes a generally sloped or horizontal portion 48 and a generally vertical portion 50. The generally horizontal portion 48 is installed generally along the upper boundary of the attic cavity 28, as generally defined by the lower side 52 of the top beams 30. The installation of the horizontal screen portion 48 against the lower side 52 of the top beam can be accomplished by any suitable means, such as by nailing, applying adhesive material, or using thin strips of wood or like material to fasten the screen material 46 to the top beams.

The vertical portion 50 of the screen material 46 is preferably installed at a position laterally across the width of the truss where the height of the attic cavity 28 is roughly equal to the height 3 8 of the insulation material 36 in the remainder portion of the attic cavity. The vertical screen portion 50 can be fixed in place by attachment to the top beams 14 or 30 and the lower beam 16 or 32. The vertical screen portion 50 can be of the same material as the horizontal screen portion 48, or can be of a different material. The purpose of the vertical screen portion is to define the inward edge or boundary of the reduced height end portion 40 to help confine the loosefil insulation during installation. The horizontal screen portion 48 also defines the reduced height end portion 40. The ceiling surface beneath the lower beam 16 or 32, such as a layer of ceiling drywall, not shown, attached to the lower beams 16 or 32, also acts to define the insulation cavity making up the reduced height end portion 40. In some attic cavities, such as attic cavity 22 shown in FIG. 1, an outside screen or solid wall, indicated at 54 in FIG. 3, would be needed to complete the insulation cavity making up the reduced height end portion 40.

Figures 3, 4:
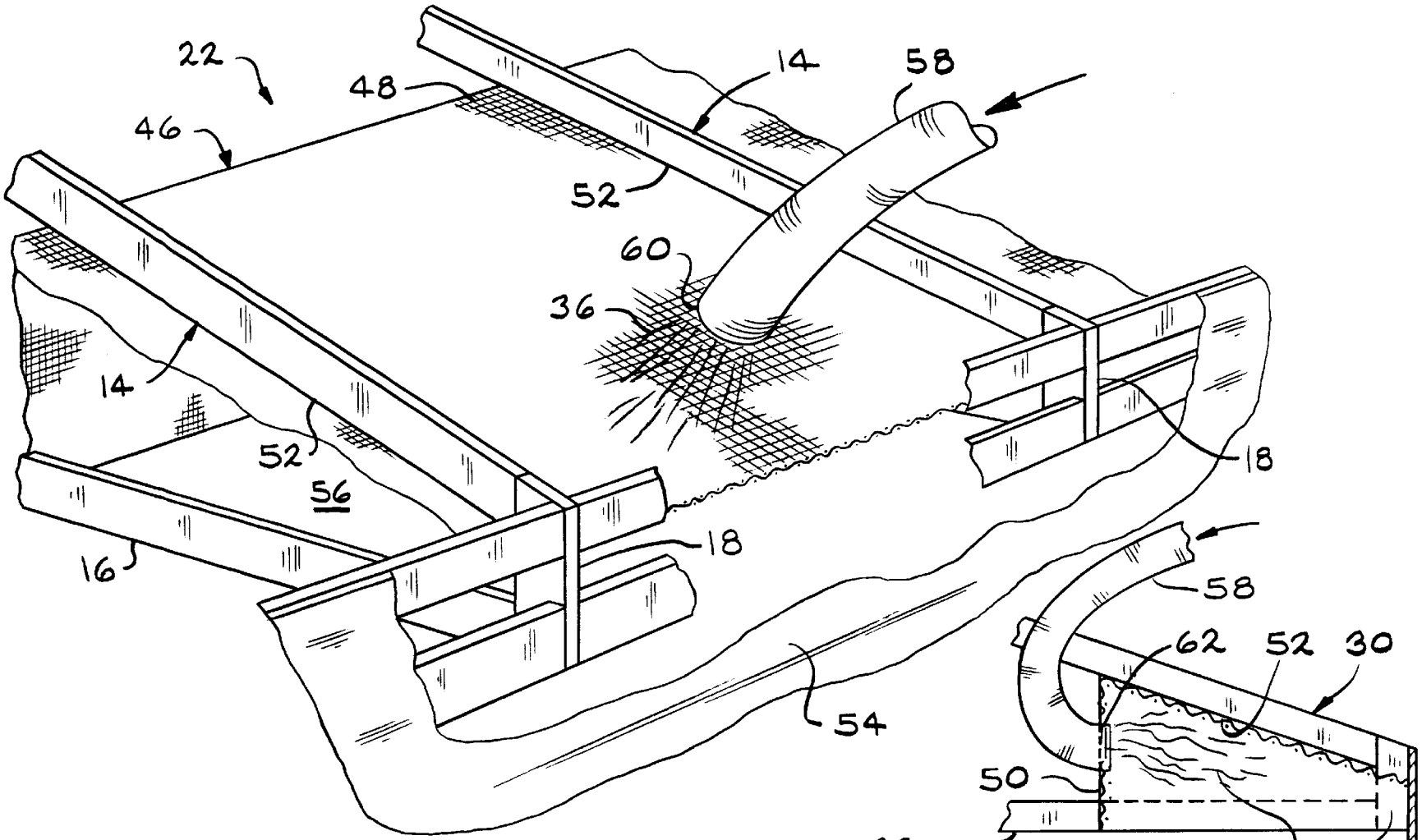
FIG. 3 is an enlarged schematic view in perspective of the attic cavity of FIG. 1 in which the loosefil material is being blown into the end portion of the attic cavity through an opening in the top of the screen material.
FIG. 4 is schematic elevational view of the attic cavity of FIG. 1 in which the loosefil material is being blown into the end portion of the attic cavity through an opening in the vertical screen portion of the screen material.

As shown in FIG. 3, the reduced height end portion 56 of the attic cavity 22 defined by the truss 10 is being filled with loosefil fiber glass insulation material 36 that is being blown in pneumatically using a hose 58. Since the attic cavity 22 shown in FIG. 3 has an outside vertical beam 18, the outside vertical screen or wall or baffle 54 is positioned to contain the insulation material 36.

The horizontal screen portion 48 of the screen material 46 is provided with an opening 60 through which the loosefil fiber glass insulation material 36 is directed. Because the screen material is porous or perforated, the air flowing with the loosefil insulation material has a way to exit from the reduced height end portion 56, and yet the insulation material will be contained. This enables the loosefil insulation material 36 to be packed in or applied more densely than would occur if the loosefil insulation material were blown in or installed in an unrestricted manner as is the case in the remainder portion 42. The resulting higher density of the loosefil insulation material 36 in the reduced height end portion 56 of the attic cavity 22 boosts the overall insulation value of the reduced height end portion 56. Preferably, the overall insulation value is at least as good as the insulation value of the insulation material in the remainder portion 42 of the attic 22, although it is to be understood that the actual insulation value at the shallow edge of the reduced height end portion 56 will be relatively small.

As shown in FIG. 4, the vertical screen portion 50 of the screen material 46 can be provided with an opening 62 to enable the hose 58 to direct the loosefil fiber glass insulation material 36 into the reduced height end portion 56. This directs the loosefil insulation material 36 in a direction from the remainder portion of the attic cavity toward the end portion of the attic cavity.

It is a well known practice in insulating an attic space to be sure that there is some air space between the top of the insulation material and the roof of the building. This air space enables any accumulated moisture to escape, thereby preventing condensation of the vapor in the insulation material and the consequent loss of thermal insulation value. The insulation method of the invention follows this practice because the screen material 46 is applied to the lower side 52 of the top beams 14, thereby leaving a free venting space between the spaced apart top beams 14 or 30.

It is to be understood that the screen material 46 can be partially or completely rigid. Nevertheless, it is preferable for the screen material 46 to be flexible for ease in application and for flexibility in being applied around irregularities invariably present in building construction. Also, flexible screen material is potentially a lower cost material than a rigid screen material. Although it is preferable for substantially all of the screen material 46 to be porous, it is to be understood that a portion of the screen material can be non-porous.

As an example of operation of the method of the invention, the attic space of a manufactured housing building can be insulated according to the method of the invention. Manufactured housing is known in the construction industry as buildings, usually deigned for residential purposes, made in a factory or assembly site and then transported to the ultimate use site. This is in contrast to a traditional residential or commercial building that is built on the site of intended use. A plurality of trusses 10 would be assembled at the top of the manufactured housing building, and the insulation material 36 would be added prior to the installation of the roof to the top of the trusses. The trusses would define an attic cavity 22 having a maximum height at the center of the building of about 18 inches and a minimum height of about 2 ½ inches at the edges of the building. A flexible fabric screen material 46 of nonwoven polyester would be applied to the trusses to define reduced height end portions 56 extending inward (interiorly) from the building edges for a distance of about 2 feet. The reduced height end portions would have a height of abut 2 ½ inches at the eave and a height of about 10 inches at the vertical screen portion 50. A fiber glass loosefil insulation hose 58 would be inserted through an opening 60 in the horizontal screen portion 48, and the loosefil insulation material 36 would be blown into the reduced height end portion 56. The resulting density of the loosefil insulation material 36 in the reduced height end portion 36 would be within the range of from about 1.0 to about 2.5 pounds per cubic foot (pcf). Then, the remainder portion 42 of the attic cavity 22 would be insulated by blowing loosefil insulation material to a height of about 12 inches, with a resulting density within the range of from about 0.4 to about 1.2 pcf The increased density in the reduced height end portion would improve the R-value or overall insulation value of the eve portion of the attic, and therefore would improve the insulation character of the manufactured housing building as a whole.

It can be seen that using the above-described blowing technique for applying loosefil insulation material into the reduced height end portions 40 of the attic, it would be possible for the horizontal screen portion 48 to be unadhered to the lower side 52 of the top beam, with the pressure of the blown in loosefil insulation material 36 being sufficient to force the horizontal screen portion 48 to balloon up into contact with the lower side 52 of the top beams 14 or 30, thereby ultimately defining the space into which the loosefil insulation material 36 is blown.

While the trusses shown in both FIGS. 1 and 2 have a reduced height at each end of the trusses, it is to be understood that the trusses could be configured in different shapes, such as, for example an overall trapezoidal shape rather than the pyramid shape shown in FIGS. 1 and 2, in which case the truss would have only one end having a reduced height. For the method of the invention to be used, the attic cavity must have a reduced height at least one end of the truss, and the screen material 46 must be applied to an end portion of the truss at one or both of the end portions. Also, it is to be understood that the installation of the insulation material into the reduced height end portions 40 and the remaining portion 42 can be accomplished in any order. The remaining portion 42 of the attic cavity 28 can be insulated after the end portions 40 of the attic cavity are insulated, or the remaining portion 42 of the attic cavity 28 can be insulated before the end portions 40. Further, while the method of the invention illustrates insulating the reduced height end portions 40 by blowing a loosefil insulation material 36, the remainder portion 42 can be insulated by any other suitable method, such as by laying batts or blankets of fiber glass insulation into the remainder portion 42.

The principle and mode of operation of this invention have been described in its preferred embodiments. However, it should be noted that this invention may be practiced otherwise than as specifically illustrated and described without departing from its scope.

What is claimed is:

1. A method of insulating an attic cavity comprising:

assembling a plurality of trusses to define an attic cavity, the trusses having sloped top beams so that the attic cavity has a reduced height end portion at least one end of the trusses;

applying a screen material to the attic cavity to define the reduced height end portion of the attic cavity;

blowing loosefil insulation material into the end portion of the attic cavity to insulate the end portion of the attic cavity; and insulating the remaining portion of the attic cavity the density of the insulation in the end portion of the attic cavity being higher than the density of the insulation in the remaining portion of the attic cavity.

2. The method of claim 1 in which the attic cavity has a reduced height at both ends of the trusses, and wherein the screen material is applied to both end portions of the trusses at the reduced height end portions of the attic cavity, and the loosefil insulation material is blown into both of the end portions of the attic cavity to insulate both of the end portions of the attic cavity.

3. The method of claim 1 including blowing the loosefil insulation material into the end portion of the attic cavity at a first density to insulate the end portion of the attic cavity, and blowing the loosefil insulation material into the remaining portion of the attic cavity at a second, lower density to insulate the remaining portion of the attic cavity.

4. The method of claim 1 in which the trusses include top beams and bottom beams, and in which the screen is positioned on a lower side of the top beams.

5. The method of claim 1 including establishing a boundary between the end portion of the attic cavity and the remainder of the attic cavity.

6. The method of claim 5 in which the boundary is established by means of a screen material.

7. The method of claim 6 in which the loosefil material is blown into the end portion of the attic cavity through an opening in the boundary.

8. The method of claim 1 in which the loosefil material is blown into the end portion of the attic cavity through an opening in the top of the screen material.

9. The method of claim 1 in which the loosefil material is blown into the end portion of the attic cavity in a direction from the remainder portion of the attic cavity toward the end portion of the attic cavity.

10. The method of claim 1 in which the attic cavity is a part of a manufactured housing building, and in which a roof is applied to the trusses after the attic cavity is insulated.

11. A method of insulating an attic cavity comprising:

assembling a plurality of trusses to define an attic cavity, the trusses having sloped top beams so that the attic cavity has a reduced height end portion at each end of the trusses;

applying a flexible, porous screen material to the attic cavity to define the reduced height end portions of the attic cavity;

blowing loosefil insulation material into the end portions of the attic cavity to insulate the end portions of the attic cavity; and insulating the remaining portion of the attic cavity the density of the insulation in the end portions of the attic cavity being higher than the density of the insulation in the remaining portion of the attic cavity.

12. The method of claim 11 including blowing the loosefil insulation material into the end portions of the attic cavity at a first density to insulate the end portions of the attic cavity, and blowing the loosefil insulation material into the remaining portion of the attic cavity at a second, lower density to insulate the remaining portion of the attic cavity.

13. The method of claim 11 in which the trusses include top beams and bottom beams, and in which the screen material is positioned on a lower side of the top beams, and further in which the loosefil material is blown into the end portions of the attic cavity through an opening in the screen material.

14. The method of claim 11 in which the loosefil material is blown into the end portion of the attic cavity through an opening in the top of the screen material.

15. The method of claim 11 in which the attic cavity is a part of a manufactured housing building, and in which a roof is applied to the trusses after the attic cavity is insulated.

16. The method of claim 1 including installing insulation material in the end portion of the attic cavity at a density within the range of from about 1.0 to about 2.5 pounds per cubic foot, and installing insulation material in the remaining portion of the attic cavity at a density within the range of from about 0.4 to about 1.2 pounds per cubic foot.

17. The method of claim 11 including installing insulation material in the end portion of the attic cavity at a density within the range of from about 1.0 to about 2.5 pounds per cubic foot, and installing insulation material in the remaining portion of the attic cavity at a density within the range of from about 0.4 to about 1.2 pounds per cubic foot.

18. A building having a plurality of trusses defining an attic cavity, the trusses having sloped top beams, thereby giving the attic cavity a reduced height end portion at least one end of the trusses, the attic cavity further having a screen material applied to the attic cavity, thereby separating the at least one reduced height end portion of the attic cavity from a remaining portion of the cavity, the attic cavity further having loosefil insulation material installed in the end portion of the attic cavity, the attic cavity further having loosefil insulation material installed in the remaining portion of the attic cavity, wherein the loosefil insulation material installed in the end portion of the attic cavity has a first density, and the loosefil insulation material installed in the remaining portion of the attic cavity has a second density, the second density being lower than the first density.

19. The attic cavity of claim 18 in which the loosefil insulation material installed in the end portion of the attic cavity has a density within the range of from about 1.0 to about 2.5 pounds per cubic foot, and the loosefil insulation material installed in the remaining portion of the attic cavity has a density within the range of from about 0.4 to about 1.2 pounds per cubic foot.

20. The attic cavity of claim 18 in which the attic cavity has a reduced height at both ends of the trusses, and wherein the screen material is applied to both end portions of the trusses at the reduced height end portions of the attic cavity, and the loosefil insulation material has been blown into both of the end portions of the attic cavity to insulate both of the end portions of the attic cavity.

21. The attic cavity of claim 18 in which the trusses include top beams and bottom beams, and in which the screen material is positioned on a lower side of the top beams, and in which there is an opening in the screen material to enable the loosefil material to pass.

* * * * *